United States Patent [19]

Crawford et al.

[11] Patent Number: 5,058,670

[45] Date of Patent: Oct. 22, 1991

[54] ORIENTED VALVE AND LATCH FOR SIDE POCKET MANDREL

[76] Inventors: Douglas W. Crawford, P.O. Box 91177, Lafavette, La. 70509; William B. Crawford; Mark S. Crawford, both of P.O. Box 1509, Houston, Tex. 77383

[21] Appl. No.: 617,385

[22] Filed: Nov. 26, 1990

Related U.S. Application Data

[63] Continuation of Ser. No. 352,119, May 15, 1989, abandoned, which is a continuation-in-part of Ser. No. 126,347, Nov. 30, 1987, abandoned.

[51] Int. Cl.[5] ..... E21B 23/03

[52] U.S. Cl. ..... 166/117.6; 166/169; 166/238

[58] Field of Search ..... 166/117, 117.5, 117.6, 166/167, 169, 237, 238

[56] References Cited

U.S. PATENT DOCUMENTS 4,273,464 6/1981 Scott ..... 166/240
4,715,441 12/1987 Crawford et al. ..... 166/117.5

FOREIGN PATENT DOCUMENTS

86/03544 6/1986 PCT Int'l Appl. ..... 166/117.5

*Primary Examiner*—Terry L. Melius

[57] ABSTRACT

In accordance with an illustrative embodiment of the present invention, a gas lift valve that is latched by a latch assembly into a seating bore in a side pocket mandrel includes a guide flange that is recieved in a slot in an internal wall of the mandrel. The guide flange functions to precisely rotationally orient and to stop the insertion of the valve within its seating bore such that a lateral gas outlet port in the valve body is directed inward toward the main bore of the mandrel. A frictional restraint also is provided to prevent accidental release of the latch assembly.

16 Claims, 2 Drawing Sheets

FIG. 1
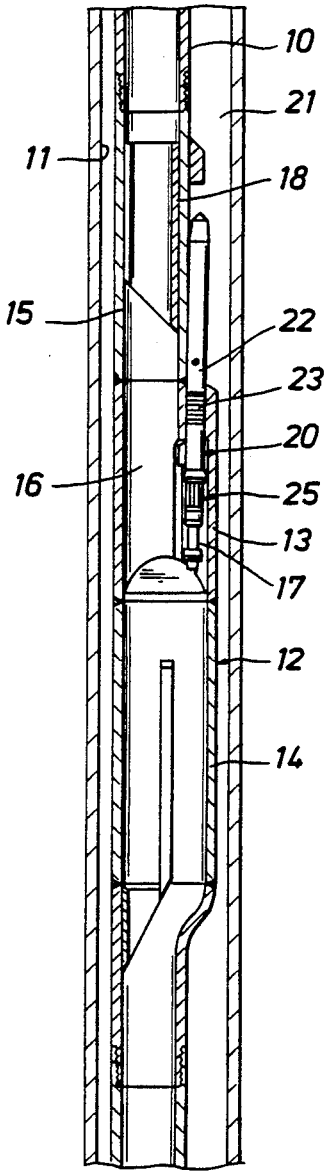
FIG. 2
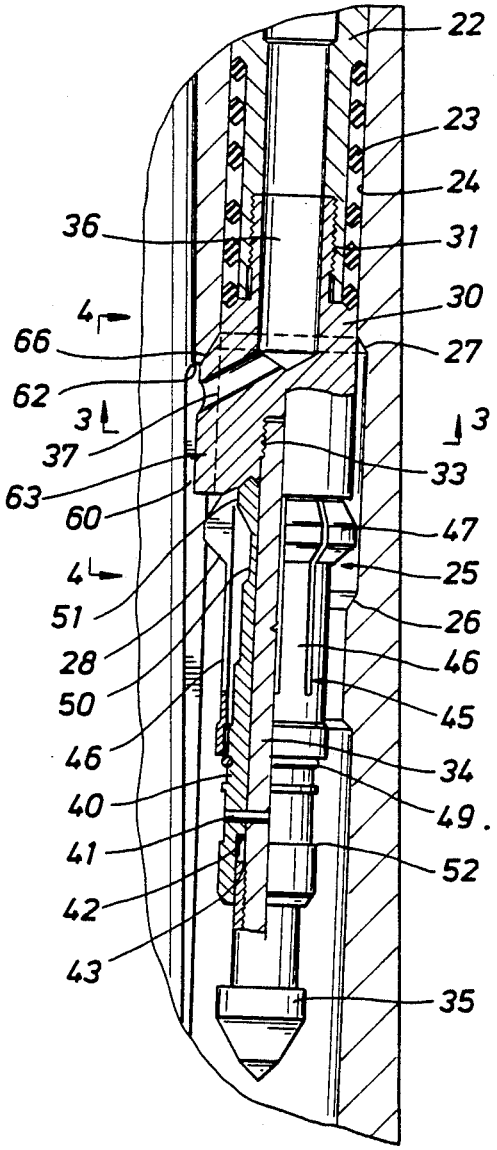
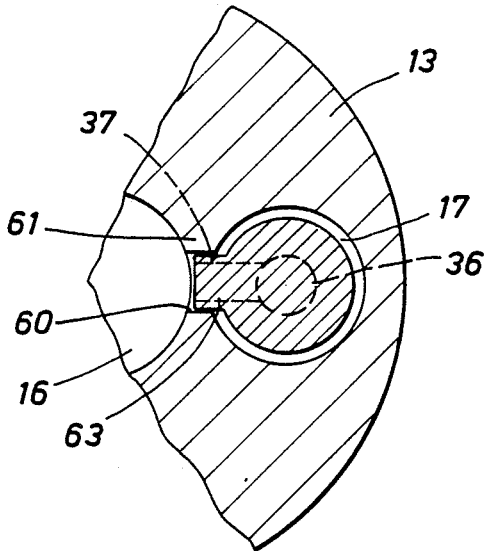
FIG. 3

ORIENTED VALVE AND LATCH FOR SIDE POCKET MANDREL

CROSS-REFERENCE TO RELATED APPLICATION

This application is a continuation of application Ser. No. 07/352,119, filed May 15, 1989, now abandoned which is a continuation-in-part of application Ser. No. 126,347 filed Nov. 30, 1987 now abandoned.

FIELD OF THE INVENTION

This invention relates generally to gas lift valves or other flow control devices that are seated in a side pocket mandrel to admit gas into the tubing during gas lift operations in a well, and particularly to a new and improved oriented gas lift valve that, when properly seated in the mandrel, has a gas flow port that directs the gas into the interior of the mandrel in a predetermined direction.

BACKGROUND OF THE INVENTION

Typical gas lift equipment comprised a side pocket mandrel having a pocket sub welded into a window in the mandrel near the lower end thereof. The sub has upper and lower polish bores in which spaced-apart packing elements on the gas lift valve are seated. Gas entry ports are provided through the outer wall of the sub between the polish bores, and the valve has an outlet flow port through its nose through which the gas passes into the interior of the mandrel in the region below the lower polish bore. An inwardly directed latch shoulder that is located above the upper polish bore cooperates with a latch on the upper end of the valve to releasably retain the valve in the pocket. A structure of this general type is shown in U.S. Pat. No. 3,827,490, issued Aug. 6, 1974.

Our U.S. patent application Ser. No. 789,313, filed, Oct. 18, 1985, illustrates and claims a new and improved side pocket mandrel having a short-length seating sub welded to the upper end of the main body section of the mandrel. The seating sub has a single polish bore that leads to the outside of the mandrel along an axis that is inclined at a small angle with respect to the axis of the main bore of the mandrel. A latch shoulder located near the inner end of the polish bore is arranged to cooperate with a latch element on the gas lift valve in order to releasably hold the valve in a position where its packing assembly sealingly engages the polish bore. The body of the valve extends out into the tubing-casing annulus, and has one or more inlet ports in the wall thereof. A gas outlet port is provided in a special section of the valve that is connected between the packing assembly and the latch assembly.

If the direction of the gas outlet passage is not properly oriented with respect to the main bore of the mandrel, high velocity gas flow over a period of time could conceivably erode inner wall surfaces of the seating sub, and result in mandrel failure should the damage becomes significant. Of course a special surfacing material could be used to inhibit damage, much in the nature of a "blast joint", however this could increase the manufacturing cost of the mandrel in an undesirable manner.

It is the general object of the present invention to provide a gas lift valve and seat sub assembly of the type described that are constructed in a manner such that when the valve is seated, the outlet gas flow port is oriented in a direction such that flow is always toward the main bore of the mandrel through which production fluid is passing.

SUMMARY OF THE INVENTION

This and other objects of the present invention are attained through the provision of a side pocket mandrel having a seating sub at the upper end thereof. The seating sub has a valve receiving bore formed to one side thereof, and a main bore formed to the other side thereof. An internal wall separates these bores, and an open-ended, elongated slot is milled in such wall in the region between the respective inner ends of the bores. The slot extends to a point adjacent a "no-go" shoulder which is formed above a latch shoulder on the sub. The body section of the valve that is between the latch assembly and the packing thereon is provided with an outwardly directed, longitudinal guide flange having a transverse dimension that slightly less than the width of the above-mentioned slot. The guide flange enters the slot as the valve is inserted into the seating bore. A gas outlet port opens transversely through the said guide flange so as to direct gas flow through the slot and into the main bore of the seating sub.

During assembly of a gas lift valve with the kick-over arm of a running tool at the surface, the valve is attached to the running connector with the guide flange rotationally oriented such that it faces inwardly toward the axis of the running tool tray. As the valve is being inserted into the receiver bore of the seating sub downhole, the guide flange will enter the slot to positively assure that the flow port is directed inwardly toward the main bore of the mandrel and that the latch also is properly oriented. Oppositely inclined surfaces may be formed on the outer end of the guide flange to assist its entry into the slot in the event that a small degree of misalignment has occurred during assembly at the surface, or as the tool is being run into the tubing. An outer end face of the guide flange is arranged to abut against the "no-go" shoulder on the seating sub, so that the valve is inserted only a precise distance into the seating bore. Thus the gas lift valve is always positively oriented in a manner such that the gas flow port is directed inwardly, or else the valve can not be seated at all. In accordance with another feature of the present invention, a frictional restraint is provided against downward movement of the collet sleeve included in the latch assembly to prevent accidental release of the latch assembly.

BRIEF DESCRIPTION OF THE DRAWINGS

The present invention has other objects, features and advantages that will become more clearly apparent in connection with the following detailed description of a preferred embodiment, taken in conjunction with the appended drawings, in which:

FIG. 1 is a schematic view of a side pocket mandrel connected in a tubing string in a well;

FIG. 2 is a fragmentary cross-sectioned view showing the gas lift valve of the present invention positioned in the seating sub of the mandrel;

FIG. 3 is a cross-section on line 3—3 of FIG. 2;

DETAILED DESCRIPTION OF A PREFERRED EMBODIMENT

Figure 4:
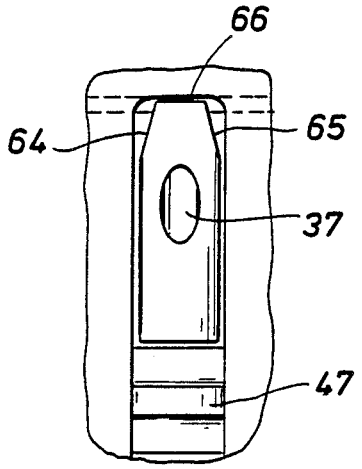
FIG. 4 is a fragmentary front elevational view of the guide flange on the valve.

Referring initially to FIG. 1, a production string of tubing 10 is disposed in a cased well bore 11. A side pocket mandrel 12 is connected in the tubing string by appropriate threads at its upper and lower ends. The mandrel 12 has a seating sub 13 welded to the upper end of the main body section 14 thereof, and a tubular member 15 that is welded to the upper end of the sub 13 may have a orienting sleeve 18 fixed to the interior thereof.

The seating sub 13 is formed with a main bore 16 that is aligned with the axis of the tubing 10, and a seating bore 17 that extends through the sub to the side of the main bore 16. The axis of the seating bore 17 preferably is inclined downward and inward at a small angle with respect to the axis of the main bore 16, for example 1½–3 degrees.

A gas lift valve 20 is shown seated in the bore 17 for the purpose of admitting lift gas from the annulus 21 into the main bore of the mandrel 12, where the gas admixes with production fluids in order to lighten the weight of the column of production fluids in the tubing 10. The valve 20 has a body 22 that carries a single external packing assembly 23 which sealingly engages in a polish bore 24 (FIG. 2) in order to prevent fluid leakage. A latch assembly 25 engages an inwardly directed latch shoulder 26 adjacent the inner end of the bore 24, and an annular "no-go" shoulder 27 is provided to control the precise distance that the valve body 22 can be inserted into the receiver bore 17 during setting. The latch assembly 25 is shown as including shoulder surfaces 28 formed by collets or the like that automatically will be positioned above the shoulder 26 as the valve is inserted, and which will releasably retain the valve in place until such time as the latch assembly is released. Upon release, the valve 20 can be withdrawn from the seating bore 17 and removed from the well for repair or replacement.

As shown in enlarged detail in FIG. 2, the valve 20 includes a special adapter sub 30 having internal threads 31 that connect it to the lower end of the valve body 22. Other internal threads 33 serve to connect the sub 30 to an elongated fishing neck 34 having a head 35 at its outer end. The sub 30 has an internal passage 36 that is communicated to the outside by a lateral port 37 that permits gas to be injected into the main bore 16 of the mandrel 12.

The neck 34 carries a locking sleeve 40 that is secured by a shear pin 41. The sleeve 40 can move downward toward the head 35, once the pin 41 is disrupted, until an internal shoulder 42 thereon stops against an external shoulder 43 on the head. A collet sleeve 45 has a plurality of circumferentially spaced, flexible fingers 46, each of which has an enlarged head 47 at its upper end. The heads 47 have lower inclined shoulder surfaces 28 thereon which can engage the latch shoulder 26 on the sub 13 to hold the valve 20 in place within the seating bore 17. The collet sleeve 45 is free to move downward to some extent along the locking sleeve 40 in the event the heads 47 encounter an obstruction, such as the reduced diameter bore below the latch shoulder 26, and an external annular recess 50 in the sleeve 40 is arranged to receive the heads as the fingers 46 resile inward to enable the heads to pass through the reduced diameter bore in the upward direction. Once the heads 47 are clear thereof, they spring back outward to their relaxed dimensions. Then as the valve 20 attempts to move downward, an enlarged diameter annular locking surface 51 on the sleeve 40 engages behind the heads 47 to prevent release thereof from the latch shoulder 26.

To unlock the latch assembly 25, an overshot-type retrieving tool is inserted over the neck 34 until gripping elements thereon engage an undercut annular shoulder 52 on the sleeve 40. Downward jarring is used to shear the pin 41, so that the locking sleeve 40 can shift downward to a position where the locking surface 51 is clear of the heads 47. In this position the heads 47 can resile inward in response to downward force, and release from above the latch shoulder 26. This permits the gas lift valve 20 to be withdrawn from the seating sub 13, so that the valve can be removed from the mandrel 12.

To prevent undesired downward movement of the collet sleeve 45 relative to the locking sleeve 40 to a release position where the heads 47 are opposite the recess 50, a suitable clutch means can be used. In the form illustrated, this means can include an 0-ring 49 that is positioned in an external annular groove on the sleeve 40. The ring 49 is sized to have an outer diameter in its relaxed state that is slightly larger than the inner diameter of the lower end of the sleeve 45, so as to engage the lower end of the latch sleeve 45 to prevent its downward movement from the position shown in FIG. 2 under the influence of gravity. As an alternative, a split snap ring could be used that has a relaxed diameter greater than the inner diameter of the lower portion of the collet sleeve 45, and an upwardly and inwardly inclined upper surface, so that when the collet sleeve is in the locked position as shown in FIG. 2, the ring flexes outward in the groove and engages the lower end of the sleeve.

As shown in FIGS. 2 and 3, an elongated vertical slot 60 is milled into the wall 61 that separates the bores 16 and 17. The slot 60 has a predetermined width, and extends to a point 62 at the level of the "no-go" shoulder 27. The adapter sub 30 of the valve 20 is provided with an outwardly directed, longitudinally extending flange 63 having a width slightly less than the width of the slot 60, and not substantially greater than the diameter of the gas outlet port 37. The flange 63 slides into the slot 60 as the valve 20 is inserted into its seat, so that the gas outlet port 37, which opens through the outer wall of the flange 63, is rotationally oriented in a manner to direct the gas flow toward the axis of the main bore 16.

A pair of oppositely inclined side surfaces 64, 65 may be provided on the upper portion of the flange 63 to assist in guiding the flange into the slot 60 in the event of a small degree of initial misalignment. Alternatively, the lower end portion of the slot 60 may have outwardly flaring side walls, as shown in dotted lines in FIG. 1, to achieve the same result. The inclined upper end surface 66 of the flange 63 is arranged to stop against the "no-go" shoulder 27 to limit the distance that the valve 20 can be inserted into seating bore 17.

Figure 5:
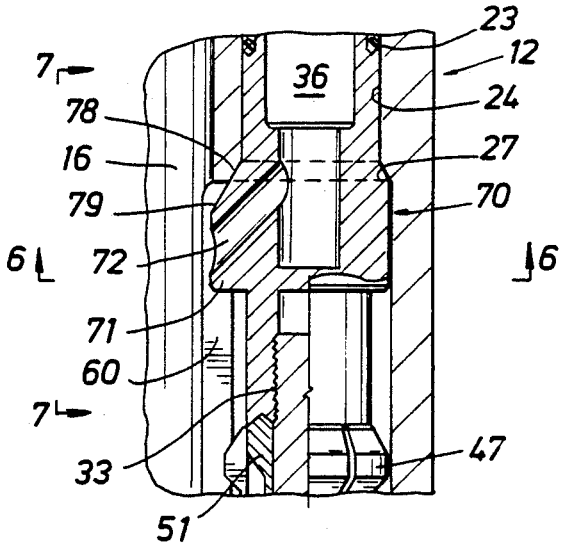
FIG. 5 is a fragmentary longitudinal sectional view of another embodiment of a modified gas lift valve modified adapter sub positioned in the seating bore of the mandrel.

As seen in FIG. 5, a modified gas lift valve adapter sub 70 is shown seated against the downward and outwardly inclined, annular "no-go" shoulder 27 at the lower end of the polish bore 24 of the side pocket mandrel 12. The adapter sub 70 has an outwardly extending guide flange 71 that is received in the axially extending slot 60 in order to rotationally orient the gas lift valve 20 such that the gas flow port 72 is directed inwardly toward the main bore 16 of the mandrel 12.

Figure 7:
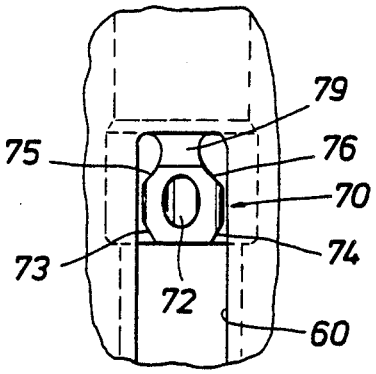
FIG. 7 is a fragmentary front elevational view of the guide flange on the modified adapter sub shown in FIG. 5.
Figure 6:
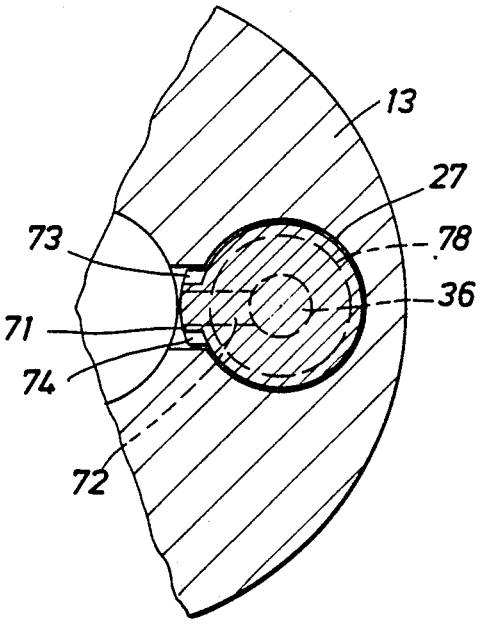
FIG. 6 is a cross-sectional view taken generally along line 6—6 of FIG. 5.

As shown in FIGS. 6 and 7, the guide flange 71 has inclined lower surfaces 73,74 as well as inclined upper edge surfaces 75,76. In a preferred construction the lower surfaces are each inclined at an angle of about 30° to the vertical, whereas the upper surfaces are inclined at an angle of about 45° to the vertical. The presence of such inclined surfaces provides a means of caming the guide flange 71 into alignment with the slot 60 in the event of some fairly small initial misalignments.

As distinguished from the embodiment shown in FIG. 2, the stop shoulder 78 which abuts the "no-go" shoulder 27 extends entirely around the circumference of the adapter sub 70 to provide an increased area of engagement which correspondingly reduces unit pressures for a given axially upwardly directed force on the valve 20. A portion of the surface area of the stop shoulder 78 is provided by the inclined upper surface 79 of the guide flange 71 as illustrated in FIG. 5. Of course the full-circle engagement of the stop shoulder 78 eliminates stress concentrations, and tends to center the packing 23 within the polish bore 24 to ensure a leak-proof arrangement.

OPERATION

In operation, a gas lift valve 20 constructed as shown in the drawings has the latch mechanism 25 coupled to a typical running head on the upper end of the arm of the kick-over tool, with the guide flange 63 turned inward so that it faces the axis of the tray of the tool. As described in our application Ser. No. 679,263, filed Dec. 7, 1984 the arm mechanism is inwardly biased so that the gas lift valve 20 remains tucked into the tray as the kick-over tool is run into the tubing on wireline. When the depth indicator of the wireline which shows that the kick-over tool has been lowered to a point below the side pocket mandrel in which the valve is to be set, the tool is stopped and then raised upward. As described in application Ser. No. 679,263, a pair of initially misaligned keys cooperate with the helical surfaces and slot of the orienting sleeve 18 in the mandrel to orient the tool so that the arm and valve are generally aligned with the seating bore 17, and to release a wing assembly that engages ramp surfaces in the mandrel to cause the arm assembly to pivot outward. Then as the kick-over tool is raised further upward, the valve 20 will be inserted into and through the seating bore 17 until the upper end of the guide flange 63 engages the "no-go" shoulder 27. During such moment, the heads 47 will have flexed inward into the recess 50 in order to bypass the shoulder 26, after which they spring outward to the positions shown in FIG. 2. At this point, upward jarring is employed to shear a pin and cause release of the running head from the latch assembly 25. Then the kick-over tool can be withdrawn from the tubing, leaving the gas lift valve 20 in place.

As the valve 20 enters the seating bore 17, the guide flange 63 will enter the lower open end of the slot 60 to ensure that the gas outlet port 37 is directed inward toward the axis of the main bore of the mandrel. Should there be a small degree of initial misalignment, one of the inclined surfaces 64 or 65 on the upper outer end of the flange 63 will cause the valve 20 to rotate to a position of proper orientation.

During gas lift operations, the pressurized gas in the annulus enters the body of the valve 20 and passes into the passage 36 when the pressure setting of the valve element is exceeded. The gas enters the main bore of the mandrel 12 via the outlet port 37 in the guide flange 63. A pressure differential in a downward direction across the packing element on the valve 20 will cause the collet heads 47 to move down and to engage the latch shoulder 26, and the locking surface 51 to move underneath the heads to lock them in outer positions. Thus the valve 20 is held securely within the seating bore 17. The clutch ring 49 prevents the collet sleeve 45 from dropping downward to a position where the heads 47 are below the locking surface 51.

The valve 20 can be removed from the mandrel 12 for replacement or repair using a procedure similar to that used to set the valve, except that a retrieving head is used in place of the running head on the upper end of the kick-over arm assembly.

It now will be recognized that a new and improved oriented gas lift valve construction has been disclosed. The lift gas is injected only into the main bore of the mandrel, where the gas is admixed with, and entrained in, the production fluids, without causing erosion problems on adjacent inner surfaces on the mandrel. The present invention also can be used to rotationally orient a latch system having, for example, three dogs that engage the latch shoulder 26 to releasably retain the valve in the seat. When used with this type of latch system, the flange 63 or 70 is formed about a radial line that is equidistant between two adjacent radial lines that define the travel paths of adjacent dogs. This construction ensures that a dog can not be located in the slot 60 when the valve is set, and thus fail to provide a stop against outward movement of the valve 20.

Since certain changes or modifications may be made in the disclosed embodiment without departing from the inventive concepts involved, it is the aim of the appended claims to cover all such changes and modifications falling within the true spirit and scope of the present invention.

What is claimed is:

1. A gas lift valve apparatus for use with a side pocket mandrel having a main bore, a seating bore laterally offset from said main bore, and a longitudinal slot formed in a wall of said mandrel between said man and seating bores, said valve apparatus comprising: a body section having guide means thereon adapted to enter said slot and maintain rotational orientation of said body section in a predetermined position, said body section having a gas flow passage; and outlet port means in said body section communicating with said passage and opening through an outer wall of said guide means, whereby lift gas emanating from said port means is directed only toward the main bore of the mandrel.

2. The apparatus of claim 1 wherein said guide means is an outwardly directed, elongated flange formed as an integral part of said body section.

3. The apparatus of claim 1 wherein said body section has an annular shoulder extending about its entire outer periphery providing a stop surface for limiting the distance said valve apparatus can be inserted into said seating bore, and said guide means comprises an outwardly directed flange integral with said body section and positioned adjacent said annular shoulder.

4. The apparatus of claim 3 wherein said flange has an outer end surface forming a smooth continuation of said shoulder.

5. The apparatus of claim 2 further including stop surface means on said flange for limiting the distance said valve apparatus can be inserted into said seating bore.

6. The apparatus of claim 5 wherein said flange has oppositely inclined side surfaces on one end portion thereof for assisting in causing entry of said flange into the outer end of said slot.

7. The apparatus of claim 2 wherein the lower end section of said slot has a widened dimension to assist in causing entry of said flange thereinto.

8. A gas lift apparatus comprising: a tubular valve body having an axial gas flow passage; a longitudinally extending, outwardly directed guide flange on the exterior of said body; and port means extending through said guide flange and connected with said passage for communicating said flow passage with the interior of a side pocket mandrel, said guide flange having substantially parallel side wall surfaces that are spaced apart a distance not substantially greater than the diameter of said port means.

9. The apparatus of claim 8 further including cam surface means on the upper portion of said guide flange for causing automatic orientation of said guide flange and valve body in said side pocket mandrel.

10. The apparatus of claim 9 wherein said cam surface means includes oppositely inclined surfaces on said upper portion of said guide flange.

11. The apparatus of claim 10 wherein said guide flange has an upper end surface that extends between said inclined surfaces to provide a stop shoulder that is arranged to limit entry of said valve body into a seating bore to a predetermined distance.

12. The apparatus of claim 8 wherein said guide flange is adapted to be aligned with an open-ended slot in said side pocket mandrel for positioning said apparatus therein, and wherein said valve body has an annular surface extending about its entire outer periphery to provide a stop surface to limit movement of said apparatus with respect thereto.

13. The apparatus of claim 12 wherein said guide flange has an outer surface forming a smooth continuation of said shoulder.

14. The apparatus of claim 8 further including latch means connected to said body for releasably securing said body in a seating bore, said latch means including clutch means for preventing accidental release of said latch means.

15. Latch apparatus for use in securing a flow control device in a seating bore of a side pocket mandrel, comprising: a fishing neck; a control sleeve mounted on said fishing neck and having an enlarged diameter locking surface and an external annular release recess adjacent said locking surface; a collet sleeve movable relatively along said control sleeve, said collet sleeve having flexible spring fingers with enlarged heads at the ends thereof, said heads being engaged by said locking surface to prevent inward movement thereof to lock said latch apparatus, said heads being movable into said recess to release said latch apparatus; and clutch means for providing a frictional restraint against movement of said collet sleeve from a locked to a released position.

16. The apparatus of claim 15 wherein said clutch means comprises a resilient member located in an external groove on said control sleeve, said resilient member having a relaxed outer diameter that is greater than the inner diameter of said collet sleeve so as to engage an end surface thereof when said end surface moves toward said resilient member.

* * * * *